United States Patent [19]

Furuhashi

[11] 4,445,005

[45] Apr. 24, 1984

[54] HEADPHONE

[75] Inventor: Satoru Furuhashi, Yao, Japan

[73] Assignee: Hosiden Electronics Co., Ltd., Osaka, Japan

[21] Appl. No.: 259,224

[22] Filed: Apr. 30, 1981

[30] Foreign Application Priority Data

May 7, 1980 [JP] Japan ..... 55-62953[U]
May 7, 1980 [JP] Japan ..... 55-62954[U]
May 8, 1980 [JP] Japan ..... 55-62768[U]

[51] Int. Cl.[3] ..... A41D 21/00
[52] U.S. Cl. ..... 179/156 R; 2/209
[58] Field of Search ..... 179/156 R; 2/209; 403/398, 399, 155; 24/211 R, 211 L, 137 A, 137 R

[56] References Cited

U.S. PATENT DOCUMENTS

| | | | |
|---|---|---|---|
| 358,718 | 3/1887 | Basch | 2/209 |
| 817,457 | 4/1906 | Turner | 179/156 R |
| 1,056,995 | 3/1913 | Ingram | 179/156 R |
| 1,167,368 | 1/1916 | Adams-Randall | 179/156 R |
| 2,240,138 | 4/1941 | Johns | 24/211 L |
| 2,554,808 | 5/1951 | Bluhm | 24/137 R |
| 2,580,495 | 1/1952 | Woods | 24/211 R |
| 3,088,184 | 5/1963 | Bittner | 24/211 L |
| 3,562,816 | 2/1971 | Hutchinson | 2/209 |
| 4,335,838 | 6/1982 | Bisk | 24/137 A |

*Primary Examiner*—G. Z. Rubinson
*Assistant Examiner*—A. C. Schroeder
*Attorney, Agent, or Firm*—Pollock, Vande Sande & Priddy

[57] ABSTRACT

An arcuate central band piece has coupled thereto at both ends arcuate side band pieces of the same curvature of the central band piece by coupling means, forming a substantially circular headphone band as a whole. Each of the coupling means is arranged so that the side band pieces can be turned about axes lying in the plane formed by the band pieces, by which the headphone band can be folded in thirds. A receiver is attached to each of the side band pieces.

6 Claims, 26 Drawing Figures

HEADPHONE

BACKGROUND OF THE INVENTION

The present invention relates to a headphone of the type wherein a pair of receivers, each having incorporated therein a transducer for converting an electric signal into an acoustic signal, are each attached to a band and, while in use, held to the ear by the band over the head.

Conventional types of headphones employ a single band of resilient material and receivers are respectively connected to both end portions of the band. The headphone of this type is inconvenient to use because the positions of the receivers cannot be adjusted in accordance with a particular shape or hair-style of the head and because it is sometimes difficult to hold the receivers correctly to both ears with proper pressure. Further, the conventional headphones cannot be folded and hence consume much space which increases the charges for custody or transportation; furthermore, they are not handy to carry.

It is an object of the present invention to provide a headphone which is free from the abovesaid defects of the prior art headphones and which occupies less space while in custody and hence reduces the expense for custody or transportation and is handy to carry.

Another object of the present invention, is to provide a headphone which permits adjustment of the positions of receivers so that they are each held to the ear by the band over the head and which can be folded down to a small size.

SUMMARY OF THE INVENTION

According to the present invention, a headphone band having joined thereto a pair of receivers comprises three band pieces which are divided in the lengthwise direction of the band. These band pieces are formed arcuately to have the same curvature and two side band pieces are attached to one end to both ends of the central band piece in such a manner that they can be folded up to lie in adjacent and substantially parallel relation in a vertical direction or in a lateral direction. In order that the band pieces may be folded up to lie in the lateral direction, the side band pieces are coupled at one end to both ends of the central band piece so that each of them can be turned about an axis lying in a plane formed by the arc of the central band piece and on only one side of the plane. In order that the band pieces may be folded up to lie in the vertical direction, the side band pieces are overlapped at one end on both ends of the central band piece so that they can each be turned about one end of the central band piece. In this case, by sliding both side band pieces on the central one in its lengthwise direction, the positions of the receivers attached to the side band pieces can be adjusted to be properly held to the ears by the band over the head. Such adjustment can also be achieved by attaching the receivers to the side band pieces in a manner to be slidable thereon. In such a case, each of the side band pieces is resiliently held by a pair of holding pieces and the receiver is attached to one of the holding pieces in such a manner that the position of the receiver on the side band piece can be changed and the receiver can be removed from the side band piece. It is also possible to couple the pair of holding pieces by a resilient coupling piece to resiliently press the half portion of each holding piece and, if necessary, to couple the receiver with the holding piece.

DESCRIPTION OF THE PREFERRED EMBODIMENTS

Figure 2:
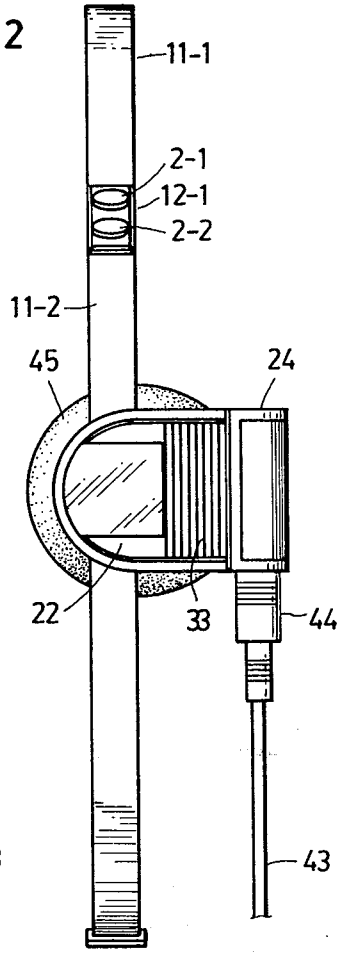
FIG. 2 is a right side view of the headphone depicted in FIG. 1.
Figure 1:
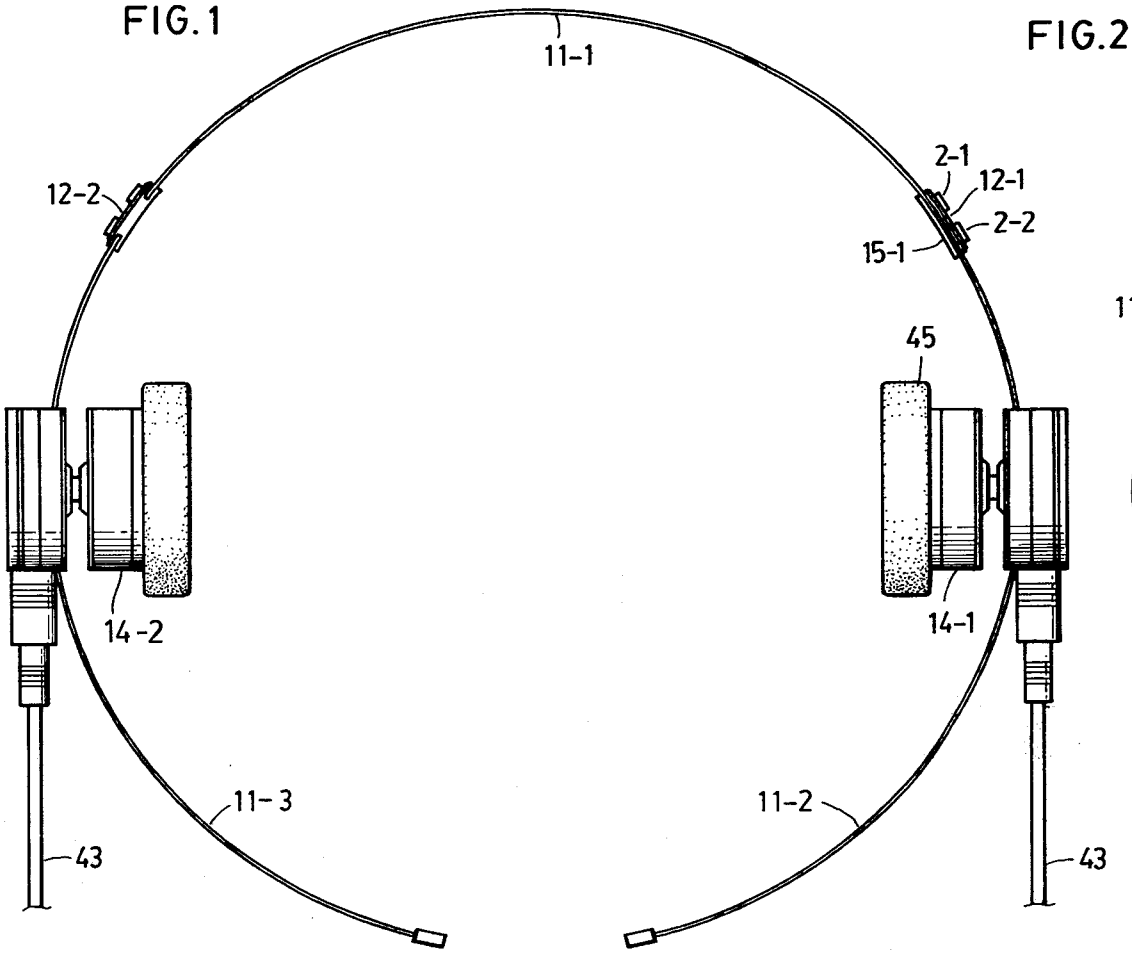
FIG. 1 is a front view showing an example of the headphone of the present invention.

FIGS. 1 and 2 illustrate an embodiment of the headphone of the present invention. A headphone band comprises three-elongated band pieces 11-1, 11-2 and 11-3 of substantially the same length and curvature. The central band piece 11-1 is coupled at one end with the side band piece 11-2 by first coupling means 12-1 and at the other end with the other side band piece 11-3 by second coupling means 12-2. These band pieces 11-1, 11-2 and 11-3 are made, for example, of a resilient resinous material so that they are band-like in shape. In the state of being assembled together by the coupling means 12-1 and 12-2, the band pieces 11-1, 11-2 and 11-3 lie in the same plane, substantially forming a circle.

Figure 4:
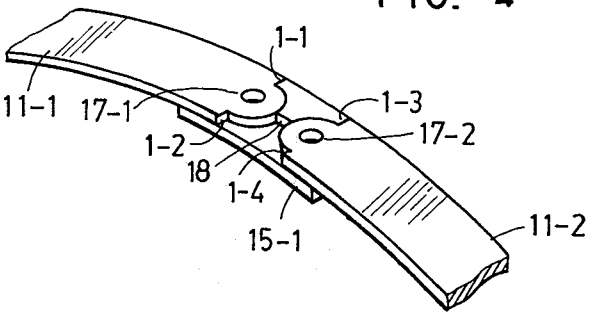
FIG. 4 is a perspective view showing the coupling means 12-1 partly assembled.
Figure 3:
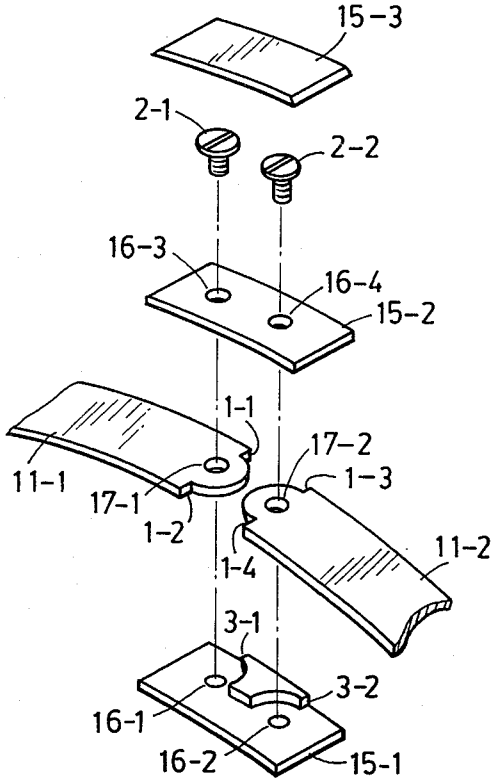
FIG. 3 is an exploded perspective view of coupling means 12-1 used in the headphone shown in FIG. 1.
Figure 6A:
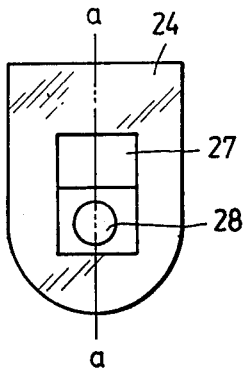
FIG. 6A is a front view of a holding piece 21 used in FIGS. 1 and 5.
Figure 6B:
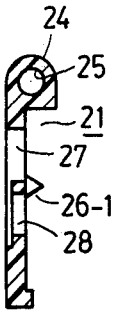
FIG. 6B is a sectional view taken on the line a—a in FIG. 6A.
Figure 6C:
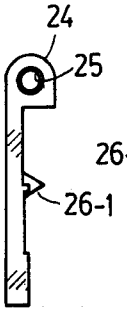
FIG. 6C is a left side view of the holding piece shown in FIG. 6A.
Figure 6D:
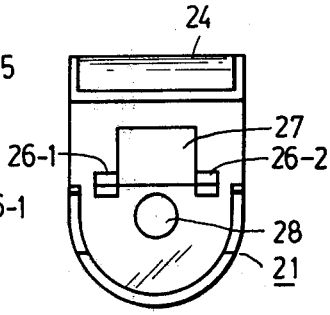
FIG. 6D is a rear view of the holding piece shown in FIG. 6A.
Figure 7E:
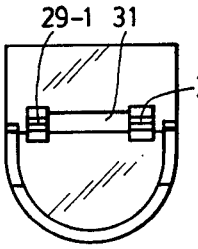
FIG. 7E is a rear view of FIG. 7B.
Figure 7D:
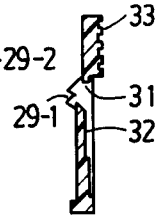
FIG. 7D is a sectional view taken on the line b—b in FIG. 7B.
Figure 7C:
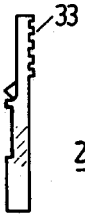
FIG. 7C is a left side view of FIG. 7B.
Figure 7B:
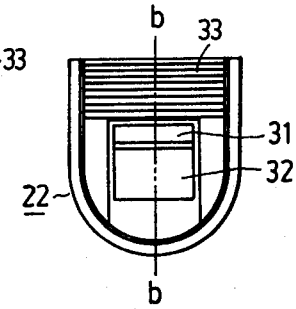
FIG. 7B is a diagram showing the state in which a name plate has been removed from the holding piece depicted in FIG. 7A.
Figure 7A:
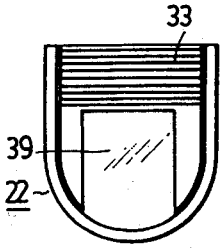
FIG. 7A is a front view of a holding piece 22.

Receivers 14-1 and 14-2 are respectively mounted on the side band pieces 11-2 and 11-3 in a manner to be slidable thereon. The receivers 14-1 and 14-2 each have incorporated therein an electroacoustic transducer, though not shown. The coupling means 12-1 and 12-2 are arranged so that the side band pieces 11-2 and 11-3 may be turned or folded relative to the central band piece 11-1 in the same direction about axes lying in the plane formed by the headphone band as a whole. Since the coupling means 12-1 and 12-2 are of the same construction, a description will be given of the arrangement of the coupling means 12-1. As depicted in FIGS. 3 and 4, the coupling means 12-1 is composed of strip-like coupling pieces 15-1 and 15-2 of substantially the same width as the band pieces 11-1 and 11-2, the coupling pieces 15-1 and 15-2 respectively having formed therein threaded holes 16-1, 16-2 and 16-3, 16-4 in alignment in their lengthwise direction. The coupling pieces 15-1 and 15-2 are bent to have the same curvature as the band pieces 11-1, 11-2 and 11-3. The end portions of the band pieces 11-1 and 11-2 to be coupled together are formed substantially semicircular, and stepped portions 1-1, 1-2 and 1-3, 1-4 are respectively formed on both sides of the semicircular end portions. Through holes 17-1 and 17-2 the diameters of which are a little larger than the diameters of the holes 16-1, 16-2, 16-3 and 16-4 are respectively formed in the semicircular end portions of the band pieces 11-1 and 11-2 centrally thereof. The end portions of the band pieces 11-1 and 11-2 are sandwiched between the coupling pieces 15-1 and 15-2, with the holes 16-1, 16-3 and 16-2, 16-4 aligned with the through holes 17-1 and 17-2, respectively, and screws 2-1 and 2-2 are respectively screwed into the holes 16-1, 16-3 and 16-2, 16-4, by which the band pieces 11-1 and 11-2 are rotatably coupled together.

The rotational movement of the band pieces 11-1 and 11-2 about the screws 2-1 and 2-2 is permitted within an angle on only one side of the lengthwise direction of the coupling piece 15-1 and their rotational movement into the other side is inhibited so that the band pieces 11-1 and 11-2 may be retained in the same circular arc. To this end, for example, a stopper 18 is fixedly mounted as by adhesive binder on the coupling piece 15-1 or formed integrally therewith between the end portions of the band pieces 11-1 and 11-2. The stopper 18 is substantially triangular in shape and a little thicker than the band pieces 11-1 and 11-2 and one side of its triangular configuration lies along one side margin of the coupling piece 15-1 in its lengthwise direction. The two other sides of the triangular configuration of the stopper 18 are made arcuate to conform to the peripheral edges of the semicircular end portions of the band pieces 11-1 and 11-2 and make loose contact therewith. The stopper 18 has straight portions 3-1 and 3-2 for contact with the stepped portions 1-1 and 1-2 of the band pieces when they are arranged on the same circular arc. A cover 15-3 may be mounted on the coupling piece 15-2 as required. The holes 16-3 and 16-4 of the coupling piece 15-2 need not always be threaded and the coupling piece 15-2 may be omitted. The coupling pieces 15-1 and 15-2 may be assembled together by means of caulking instead of using the screws.

Figure 5:
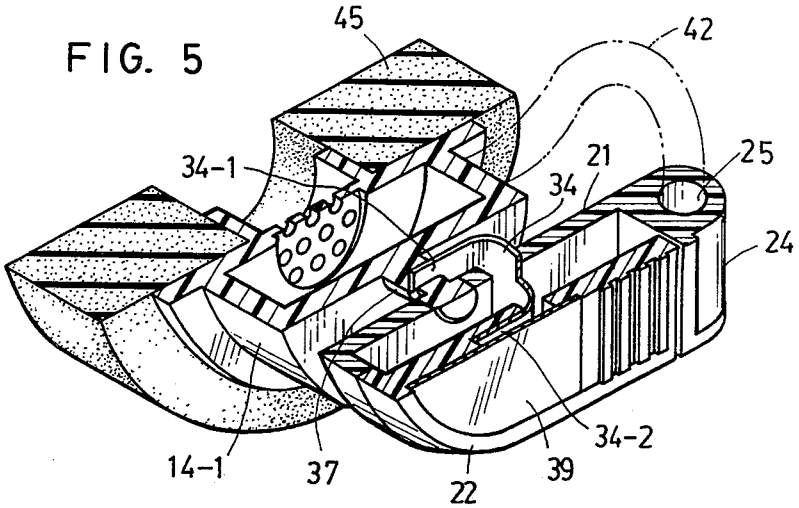
FIG. 5 is a perspective view, partly cut away, showing receiver mounting means utilized in the example of FIG. 1.

The receivers 14-1 and 14-2 are slidably mounted on the side band pieces 11-2 and 11-3, respectively, as mentioned previously; since they are mounted on the side band pieces in the same manner, a description will be given of the arrangement for mounting the receiver 14-1 on the side band piece 11-2. As depicted in FIG. 5, a pair of holding pieces 21 and 22 are rotatably coupled together centrally thereof and, by a spring 34, the holding pieces 21 and 22 are urged against each other. The holding piece 21 is formed, for example, of synthetic resin into a tongue-like shape and has an expanded portion 24 expanded to one end side of the holding piece 22, as shown in FIG. 6. The expanded portion 24 has bored therethrough a through hole 25.

Substantially triangular-prism-like projections 26-1 and 26-2 are formed integrally with the holding piece 21 substantially centrally thereof to project therefrom towards the holding piece 22 in substantially parallel relation to the expanded portion 24. An elongated hole 27 is made in the holding piece 21 between the projections 26-1 and 26-2 and the expanded portion 24. Adjacent the hole 27 an engaging hole 28 is made in the holding piece 21 on the side opposite from the expanded portion 24.

As illustrated in FIGS. 5 and 7, the holding piece 22 is also formed of synthetic resin into a tongue-like shape of substantially the same size as the holding piece 21 but the holding piece 22 is shorter than the holding piece 21 by the width of the expanded portion 24. The holding piece 22 has formed integrally therewith projections respectively having grooves 29-1 and 29-2 for engagement with the projections 26-1 and 26-2 of the holding piece 21. A slot 31 is formed in the holding piece 22 to extend between the engaging grooves 29-1 and 29-2. In the surface of the holding piece 22 on the opposite side from the holding piece 21 there is formed a square concave portion 32 contiguous to the slot 31 on the side opposite from the expanded portion 24. A non-slip portion 33 is formed by a plurality of grooves in the surface of the holding piece 22 between the slot 31 and the expanded portion 24.

Figure 8A:
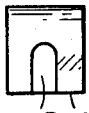
FIG. 8A is a front view of a coupling spring 34.
Figure 8B:
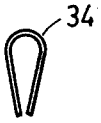
FIG. 8B is a right side view of the coupling spring 34 depicted in FIG. 8A.
Figure 8C:
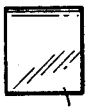
FIG. 8C is a rear view of the coupling spring 34 depicted in FIG. 8A.

In order that the holding pieces 21 and 22 may be rotatably coupled together centrally thereof and pressed against each other, the spring 34 is as shown in FIG. 8, formed by folding a plate in two. A slot 35 is cut in one plate-like portion 34-1 of the spring 34 to extend from one end portion to the bent portion thereof. The width of the slot 35 is selected to be a little smaller than the diameter of the engaging hole 28 and the inner end of the slot 35 is formed semicircular. As depicted in FIG. 5, the holding pieces 21 and 22 are assembled together with the spring 34 inserted into the hole 27 and the slot 31 to press the outside of the holding piece 21 and the concave portion 32 of the holding piece 22 respectively by the plate-like portions 34-1 and 34-2 of the spring 34. By pressing the non-slip portion 33, the holding piece 22 can be turned about the projections 26-1 and 26-2.

Figure 9:
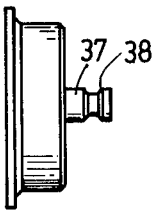
FIG. 9 is a side view showing a receiver 14-1 with its ear pad removed.

An engaging shaft 37 projects out from the back of the receiver 14-1 centrally thereof, as shown in FIGS. 5 and 9. The diameter of the engaging shaft 37 is selected to be slightly smaller than the diameter of the engaging hole 28. A ring-shaped groove 38 is formed in the intermediate portion of the engaging shaft 37. The top end portion of the engaging shaft 37 is inserted into the engaging hole 28 with the ring-shaped groove 38 engaged with the marginal edge of the slot 35, by which the receiver 14-1 is mounted on the holding piece 21.

Since the spring 34 is combined with the holding pieces 21 and 22 in a manner to hold them between its plate-like portions, as described above, the projections 26-1 and 26-2 of the holding piece 21 are respectively engaged with the engaging grooves 29-1 and 29-2 urged against each other by the biasing force of the spring 34. The engaging shaft 37 inserted into the engaging hole 28 of the holding piece 21 is retained thereto by the spring 34. If desired, a name plate 39 can be attached to the portion on the surface of the holding piece 22 on the opposite side from the expanded portion 24 with respect to the non-slip portion 33 so that the spring 34 cannot be seen from the outside.

Figure 10:
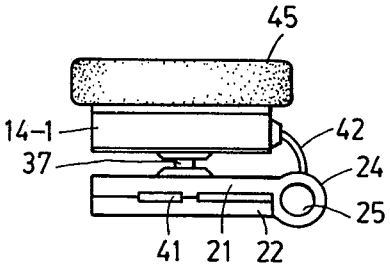
FIG. 10 is a plan view showing the state in which the receiver 14-1 is attached to mounting means.

Pushing the non-slip portion 33 of the holding piece 22 towards the holding piece 21 against the biasing force of the spring 34, the holding piece 22 is turned about the engaging grooves 29-1 and 29-2 and the end portions of the holding pieces 21 and 22 on the opposite side from the expanded portion 24 are separated from each other. The side band piece 11-2 can be held between these end portions of the holding pieces 21 and 22, as depicted in FIG. 10. In order that the receiver 14-1 may be moved along the side band piece 11-2 held between the holding pieces 21 and 22, a guide groove 41 can be formed in the holding pieces 21 and 22 at the position where they hold the side band piece 11-2. The holding pieces 21 and 22 are retained by resiliency and friction at a desired position on the side band piece 11-2.

Though not shown, a jack is provided in the through hole 25 of the expanded portion 24 and, further, though not shown, an electro-acoustic transducer is housed in the receiver 14-1, as referred to previously, and a lead wire 42 connected to the transducer is connected to the jack in the through hole 25. A plug 44 connected to one end of a cord 43 for applying an electric signal to the receiver 14-1 is detachably inserted into the jack. Soft ear pads as of urethane rubber are each attached to each of the receivers 14-1 and 14-2 on the side of the ear.

Figure 11:
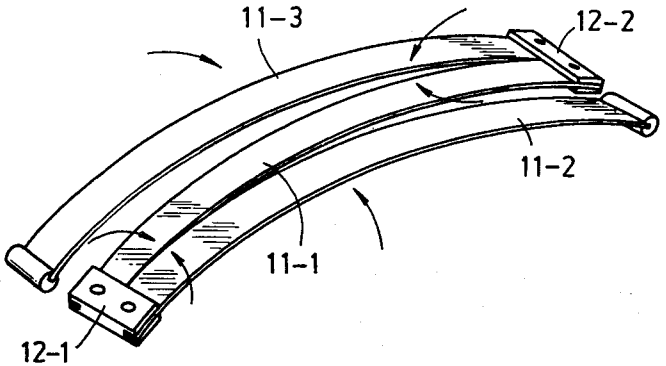
FIG. 11 is a perspective view showing the folded state of the headphone band depicted in FIG. 1.

According to the headphone of the present invention described above, the headphone band comprises the three band pieces 11-1, 11-2 and 11-3 and the side band pieces 11-2 and 11-3 are respectively connected at one end to both ends of the central band piece 11-1 so that they may be turned in the same direction when folding or unfolding the band pieces 11-2 and 11-3. That is, in FIG. 1, when folding, the side band piece 11-2 is turned towards the surface of the sheet and the side band piece 11-3 is turned towards the back of the sheet, by which the three band pieces can be arranged substantially in parallel to one another as shown in FIG. 11. In other words, the headphone band can be folded in three and hence it occupies a small space while in custody. Especially, the arrangement that permits disassembling the receivers 14-1 and 14-2 from the headphone band, as described previously in connection with FIG. 5, allows much ease in carrying the headphone, its custody and transportation.

When it is desired to use the headphones, the folded headphone band as shown in FIG. 11 can easily be unfolded. In this case, as depicted in FIGS. 3 and 4, the stepped portions 1-1 and 1-3 of the band pieces 11-1 and 11-2 respectively strike against the straight portions 3-1 and 3-2 of the stopper 18, and the circular arcs of the band pieces 11-1 and 11-2 become contiguous; thus, the headphone band can be assembled with ease. By adjusting the coupling means 12-1 or 12-2 so that the angle formed by the band pieces 11-1 and 11-2 or 11-3 is slightly changed from 180°, the receivers 14-1 and 14-2 can be held appropriately to the ears by the band over the head. Similarly, by changing the position of the band piece held by the holding pieces 21 and 22 to rove the receivers 14-1 and 14-2 along the band pieces 11-2 and 11-3, the positions of the receivers 14-1 and 14-2 can be adjusted relative to the head.

Figure 13:
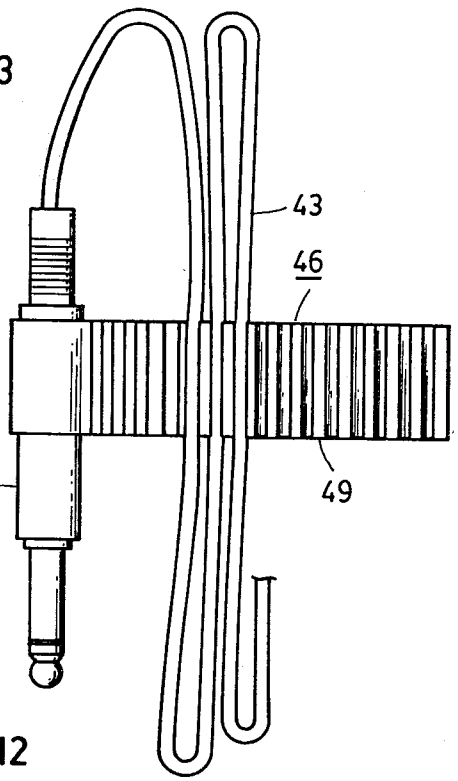
FIG. 13 is a front view of the cord holder having held thereon a cord.
Figure 12:
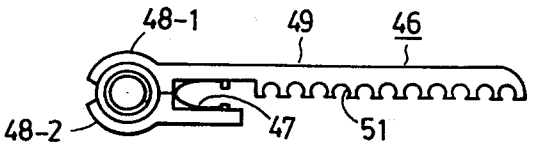
FIG. 12 is a plan view illustrating an example of a cord holder.

By pulling out the plug 44 of the cord 43 from the jack in the through hole 25, the receivers and the cord 43 can be disassembled for storage. The cord 43 thus disassembled can be held by a clip-like holding piece 46 such, for example, as shown in FIG. 12. The holding piece 46 is normally in a state in which semi-cylindrical pieces 48-1 and 48-2 are pressed to each other by the biasing force of a spring 47 to form a cylinder. By opening the semi-cylindrical pieces 48-1 and 48-2 against the biasing force of the spring 47, the plug 44 is inserted between the pieces 48-1 and 48-2 to be held therebetween. A cord holder 49 is formed integrally with the one semi-cylindrical piece 48-1 to extend in a direction perpendicular to the axis thereof, the cord holder 49 having formed therein a plurality of parallel circular grooves 51 for resiliently holding the cord 43 folded several times over, as shown in FIG. 13. The cord holder 46 is made, for example, of synthetic resin and the circular grooves 51 are formed in adjacent but closely spaced relation.

Figure 14:
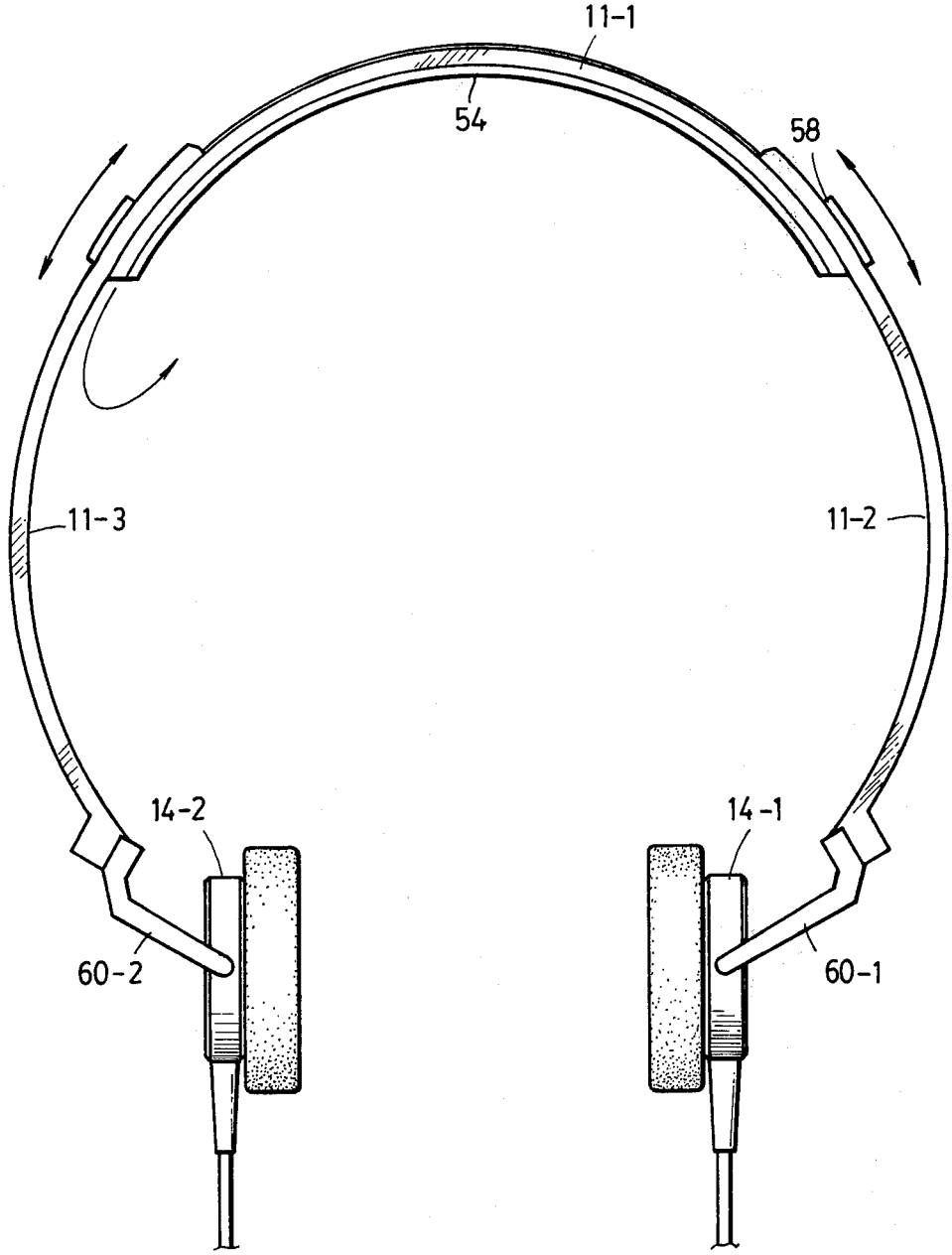
FIG. 14 is a front view illustrating another example of the headphone of the present invention.

While in the foregoing the three band pieces 11-1, 11-2 and 11-3 are folded up to lie side by side, it is also possible to employ an arrangement wherein the band pieces are folded up to lie one on another. A description will be given, with reference to FIGS. 14 to 17, of this alternative embodiment of the present invention. The side band pieces 11-2 and 11-3 are joined at one end to the both ends of the central band piece 11-1 to overlap each other, as shown in FIG. 14. Since identical coupling means are used for coupling the central band piece 11-1 and the side band pieces 11-2 and 11-3, the construction of the coupling means for the central band piece 11-1 and the side band piece 11-2 will be described.

Figure 15:
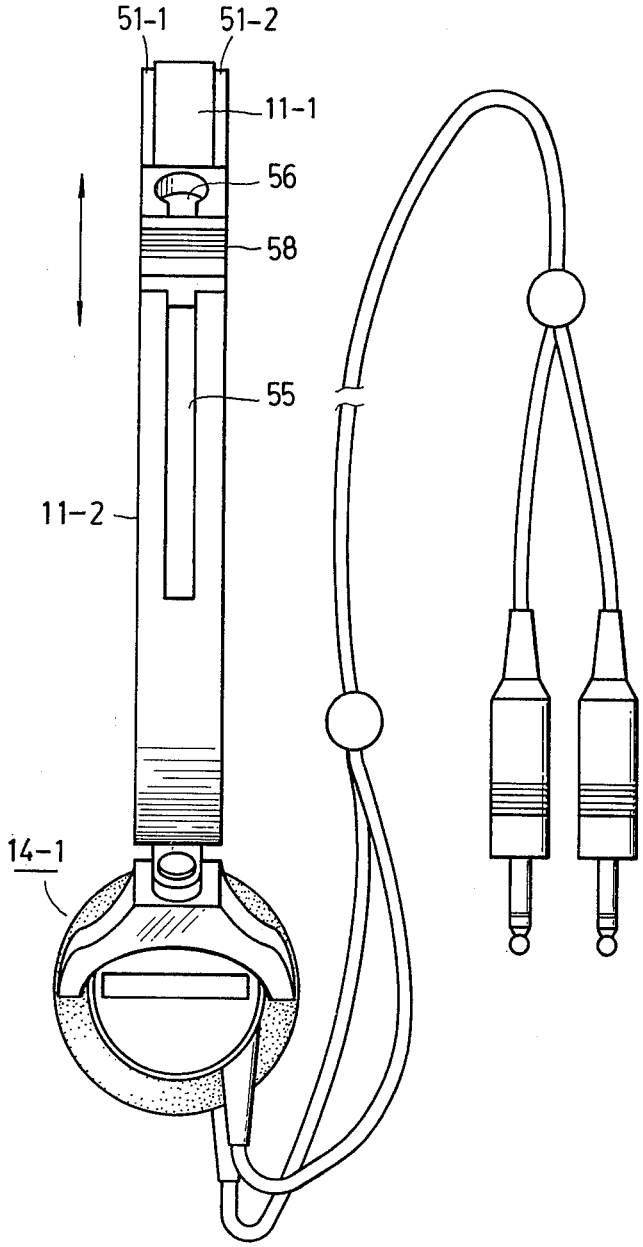
FIG. 15 is a right side view of the example shown in FIG. 14.
Figure 16:
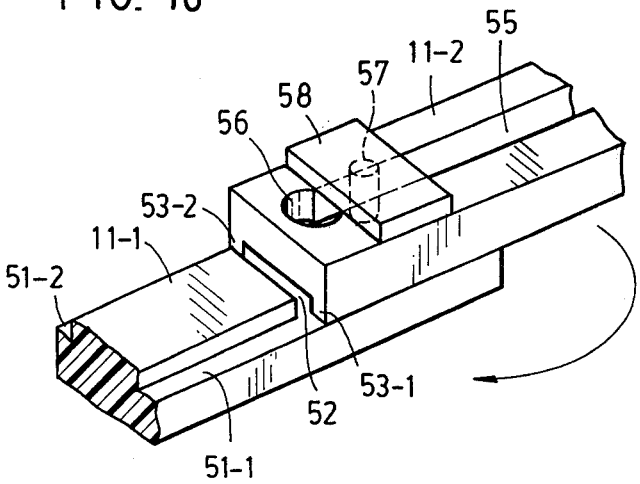
FIG. 16 is a perspective view showing coupling means employed in the example of FIG. 14.
Figure 17:
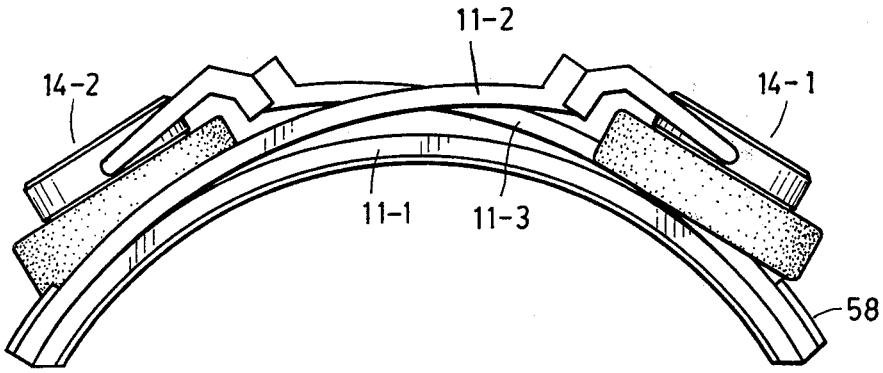
FIG. 17 is a front view showing the folded state of the headphone depicted in FIG. 14.

Both marginal portions of the band piece 11-1 are partly cut away to form stepped portions 51-1 and 51-2 (see FIG. 15). The end portions of the band piece 11-1 are each scraped off over a range a little larger than the width of the band piece to provide a surface for rotation 52 which is flush with the stepped portions 51-1 and 51-2. As depicted in FIG. 16, projections 53-1 and 53-2 are formed at both marginal side portions of the band piece 11-2 on the inside thereof for engagement with the stepped portions 51-1 and 51-2, so that the band pieces 11-1 and 11-2 can be slid relative to each other. On the inside of the band piece 11-1 is mounted a head pad 54 as of foamed urethane for soft touch with the head, as required. Also in the embodiment of FIG. 1, the head pad 54 can be mounted on the band piece 11-1.

A guide groove 55 is formed in the band piece 11-2 to extend in its lengthwise direction and the end portion of the guide groove 55 on the side of the band piece 11-1 is widened to form a substantially elliptical hole 56. An engaging pin 57 the diameter of which is slightly smaller than the width of the guide groove 55 is planted substantially at the center of the surface 52 of the end portion of the band piece 11-1 on the side of the band piece 11-2. The engaging pin 57 is positioned in the guide groove 55 of the band piece 11-2. It is also possible that the section of the engaging pin 57 be of elliptical configuration having its longer axis in the lengthwise direction of the guide groove 55. A rectangular holding plate 58 the length of which is substantially equal to the width of the band piece 11-2 is mounted on the end face of the engaging pin 57, thereby to prevent the band piece 11-2 from being disengaged from the band piece 11-1. At the end portions of the band pieces 11-2 and 11-3 on the opposite side from the band piece 11-1, the receivers 14-1 and 14-2 are rotatably attached through support pieces 60-1 and 60-2 to shafts perpendicular to the axes and planes of the respective band pieces.

Thus, the band piece 11-2 is slidable on the band piece 11-1 in its lengthwise direction and the length of the headphone band can be adjusted by sliding the band pieces 11-2 and 11-1 relative to each other; furthermore, the adjusted position can be held by the frictional engagement of the band pieces 11-1 and 11-2, the holding plate 58 and the engaging pin 57.

When the band piece 11-2 is slid on the band piece 11-1 to the position remotest therefrom, the engaging pin 57 of the band piece 11-1 lies in the hole 56 of the band piece 11-2. In this state, the engaging pin 57 is disengaged from the guide groove 55 and the end portion of the band piece 11-2 lies on the surface 52 and the projections 53-1 and 53-2 are out of engagement with the stepped portions 15-1 and 15-2. In consequence, the band pieces 11-1 and 11-2 are rotatable about the engaging pin 57 on the portion of the hole 56 in a direction perpendicular to the plane formed by the band pieces.

In this state, the band piece 11-2 can be turned about the engaging pin 57 as shown in FIG. 16, by which the band piece 11-2 is placed on the band piece 11-1. By similarly turning the band piece 11-3, the band pieces 11-2 and 11-3 are placed on the band piece 11-1; namely, the headphone band is folded up. In this folded state, the headphone occupies a small space and hence is very convenient for storage and transportation.

It will be apparent that many modifications and variations may be effected without departing from the scope of the novel concepts of this invention.

I claim:

1. A headphone comprising:

an arcuate central band piece;

first and second arcuate side band pieces which are disposed respectively at the opposing ends of tne central band piece to form substantially a circle as a whole, the side band pieces having substantially the same curvature as the central band piece;

first and second coupling means for coupling the first and second side band pieces with the central band piece so that they can turn about axes lying in a plane formed by the circular arc of the central band piece;

first and second receivers each having incorporated therein a transducer for converting an electric signal into an acoustic signal; and first and second mounting means for mounting said first and second receivers on said first and second arcuate side band pieces;

each of said first and second mounting means comprising a pair of substantially plate-like holding pieces having substantially the same shape and disposed in opposing relation to each other; pivot means disposed between said pair of holding pieces at substantially the center thereof so as to allow pivotal movement of said pair of holding pieces with respect to each other about said pivot means, said pair of holding pieces each having a through hole formed therein, and a U-shaped coupling spring inserted into said through holes of said pair of holding pieces so as to cause the leg portions of said coupling spring to press the outer surfaces of said pair of holding pieces inwardly whereby said pair of holding pieces are coupled together and resiliently pressed against each other;

each of said first and second receivers being attached to one of said pair of holding pieces of a corresponding one of said first and second mounting means by means of a pin which projects outwardly from the center of the rear surface of the receiver opposite from the sound emitting side of the receiver, said pin having a reduced diameter portion formed adjacent the free end of said pin, said one of said pair of holding pieces to which said receiver is attached including an engaging hole, spaced from the through hole in said one of said pair of holding pieces, for receiving the free end of said pin; one of the legs of said U-shaped coupling spring extending from said through hole in partially overlying relation to said engaging hole in said one of said pair of holding pieces, a slot in said one leg of said U-shaped coupling spring, said slot extending inwardly from the free end of said leg and having a width less than the diameter of said engaging hole, and said slot being positioned to overlie a portion of said engaging hole so as to rotatably engage the reduced diameter portion of said pin when the free end of said pin is inserted into said engaging hole, thereby to prevent said engaging pin from being removed in its axial direction from said engaging hole and to ensure that the receiver is attached to said one of said pair of holding pieces by said coupling spring; each of said pair of holding pieces having a recessed portion therein which recessed portions face one another to form a guide groove which extends through the mounting means formed by said pair of holding pieces in a direction parallel to the axis of pivotal movement of said pair of holding pieces, said guide groove slideably receiving therein a corresponding one of said first and second side band pieces.

2. A headphone according to claim 1 wherein the first and second coupling means are each provided with a coupling piece having a surface substantially perpendicular to the plane formed by the circular arc of the central band piece; the coupling piece having a pair of short pins standing in alignment with the lengthwise direction thereof; the pair of pins being respectively inserted into holes formed in one end portion of the central band piece and in one end portion of each of the side band pieces; and the said one end portion of the central band piece and the said one end portion of the side band piece being rotatably mounted on the coupling piece.

3. A headphone according to claim 2 wherein the end portion of the central band piece and each side band piece are held between the said coupling piece and another coupling piece.

4. A headphone according to claim 2 or 3 wherein the first and second coupling means are respectively provided with stopper means by which the first and second side band pieces are permitted to be rotatable only on one side and on the other side, respectively, of the plane formed by the circular arc of the central band piece.

5. A headphone according to claim 4 wherein the stopper means is a stopper piece mounted on the coupling piece between the central band piece and each side band piece; the stopper piece being arranged so that the central and side band pieces engage with the stopper piece and cannot turn into the opposite side of the plane formed by the circular arc of the central band piece but can turn on tne same side of the plane.

6. A headphone according to claim 1 wherein one of the holding pieces in each of said mounting means has a thick portion; the thick portion having a jack incorporated therein; a lead wire of an associated receiver being connected to the jack; and a plug, connected to one end of a cord for applying an electric signal to said receiver, inserted into the jack.

* * * * *